US005992071A

United States Patent [19]

Dahlquist

[11] Patent Number: 5,992,071

[45] Date of Patent: Nov. 30, 1999

[54] DISPLAY STAND AND METHOD

[75] Inventor: Ake L. Dahlquist, Dixon, Ill.

[73] Assignee: Sleepeck Printing Company, Dixon, Ill.

[21] Appl. No.: 08/798,843

[22] Filed: Feb. 12, 1997

[51] Int. Cl.[6] ..... G09F 1/00; G09F 15/00; A47G 5/00

[52] U.S. Cl. ..... 40/610; 40/124.09; 160/351

[58] Field of Search ..... 40/124.01, 124.09, 40/606, 610, 539; 160/351

[56] References Cited

U.S. PATENT DOCUMENTS

| | | | |
|---|---|---|---|
| 1,052,187 | 2/1913 | Stranders . | |
| 1,195,527 | 8/1916 | Stranders . | |
| 1,207,604 | 12/1916 | Morgan . | |
| 1,684,244 | 9/1928 | Richardson | 40/539 |
| 2,366,099 | 12/1944 | Gray et al. . | |
| 2,804,199 | 8/1957 | Essick . | |
| 2,942,283 | 6/1960 | Pitner | 40/124.01 |
| 3,662,807 | 5/1972 | Miller | 160/351 |
| 4,290,763 | 9/1981 | Hurst . | |
| 4,503,101 | 3/1985 | Bennett | 40/124.1 |
| 5,160,022 | 11/1992 | Mennella . | |
| 5,416,997 | 5/1995 | Dyment et al. | 40/610 |

FOREIGN PATENT DOCUMENTS

| | | | |
|---|---|---|---|
| 137930 | 1/1948 | Australia | 40/539 |
| 696391 | 8/1953 | United Kingdom | 40/539 |

*Primary Examiner*—Anthony Knight
*Assistant Examiner*—Marcus Dolce
*Attorney, Agent, or Firm*—Ryndak & Lyerla

[57] ABSTRACT

Disclosed herein is a stand-alone display device (100, 200) with one integral configuration capable of obtaining a flat configuration for efficient shipping and capable, without assembly, of achieving a deployed three-dimensional configuration. In the flat configuration, the display device (100, 200) is formed from two folded sheets adhesively secured or sandwiched between two unfolded sheets. To achieve the deployed configuration, the folded sheets are articulated (unfolded), resulting in folds in the previously unfolded sheets. In the deployed configuration, the display device is capable of supporting itself. The display device may be mass manufactured using printing press and inline finishing equipment, including plow folding stations, multiple glue application systems, a rotary cutter, and a delivery system.

28 Claims, 7 Drawing Sheets

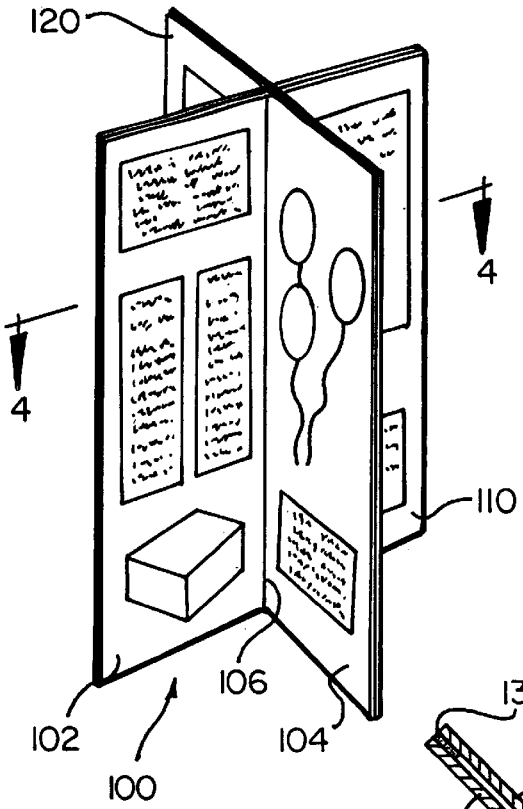
FIG.3
FIG.4
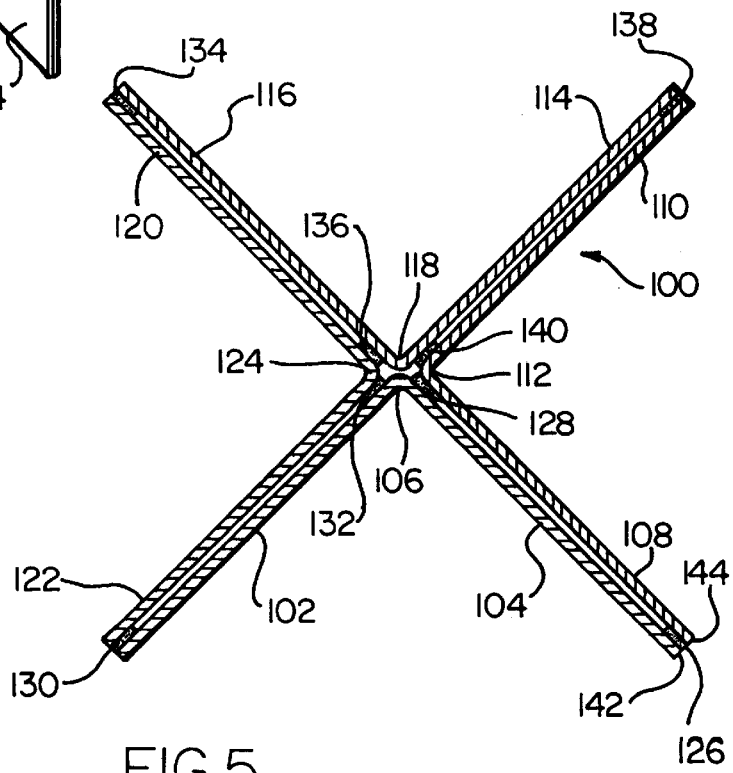
FIG.5
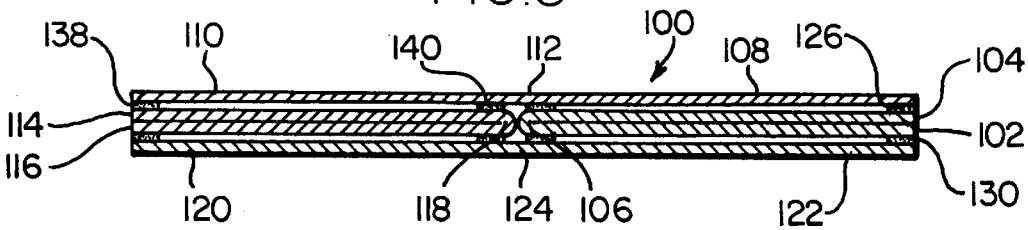

DISPLAY STAND AND METHOD

FIELD OF THE INVENTION

This invention relates to a display device and method for printed matter, and in particular, to a display device and method that includes a mass manufactured, three-dimensional, stand-alone display device.

BACKGROUND OF THE INVENTION

Three-dimensional, stand-alone display devices are known. Such devices are useful for displaying, for example, wine lists, calendars, menus, or print advertisements. One such three-dimensional, standalone display device is shown assembled and disassembled in FIGS. 1 and 2, respectively. The prior art device shown in FIGS. 1 and 2, as is common with prior display devices, is comprised of two separate sheets 10 and 12. Both sheets 10 and 12 have a slot 14 for use in assembling the sheets together as shown in FIG. 1. The display device, when assembled, is free standing and has eight (8) viewing panels 16A–H that may contain calendars, advertisements, or printed matter.

There are several problems with prior art display devices such as the display device shown in FIGS. 1 and 2. First, the display device must be shipped unassembled and assembled prior to use. Second, the use of two separate sheets to form the display device is undesirable because of the increased cost in manufacturing two parts, rather than one. Further, if the printed matter to be displayed on the display device is contiguous between adjacent panels, for example, panels 16A and 16H of FIG. 1, then the manufacturing process may cause misalignment of the printed matter in the assembled device. Moreover, errors in assembly are prone to occur, causing a noninformative display device.

To address the aforementioned problems, there is a need for a three-dimensional, stand-alone display device that may be mass manufactured at a fraction of the cost of prior devices, requires no assembly at the point of deployment, and achieves a configuration suitable for efficient shipping.

SUMMARY OF THE INVENTION

Accordingly, one aspect of the present invention provides a three-dimensional , stand-alone display device with one integral configuration capable of obtaining a flat configuration for efficient shipping and capable, without assembly, of achieving a deployable three-dimensional configuration.

The display device in accordance with the present invention may be mass manufactured using commercially available printing press and inline finishing equipment.

In one aspect of the present invention, a display device is formed from a first unfolded sheet and a second unfolded sheet, each unfolded sheet having an inner surface and an outer surface, and a first edge and an opposite second edge. The display device also has two folded sheets, each of the folded sheets having an inner surface and an outer surface, and a fold defining a point of intersection between a first half and a second half of the folded sheets. To form the flat configuration of the display device, the two folded sheets are secured between the inner surfaces of the unfolded sheets with the folds of the two folded sheets being adjacent or near each other. The folded sheets are secured between the unfolded sheets in a fixed manner, such as through the use of adhesive. The folded and unfolded sheets are selected to be of a thickness such that the sheets are pliable with some amount of force but are generally capable of retaining a configuration without additional support. Preferably, the sheets are paper with a thickness of 0.007 inches.

For deployment as a display device, the folded sheets are articulated, which due to the securing of the folded and unfolded sheets, causes the unfolded sheets to also articulate allowing the device to achieve an open configuration wherein the device can stand on its own.

The size, length, width, shape and configuration of the display device may vary. In one configuration, the folded sheets that are secured between the unfolded sheets are spaced apart. This increases the number of viewing panels for the display device.

In another aspect of the invention, a method is provided for forming the display device. The method may require plow folding stations, multiple glue application systems, a rotary cutter and a delivery system. In accordance with the method, a web of paper is conveyed along a first path of a delivery system. The web may alternatively be cut to produce two, three or four separate ribbons or webs for forming embodiments of the display device.

Where four ribbons are cut from one web of paper, the four ribbons may be realigned in an angle bar into a vertical alignment, one above the other, and transported along a path in that configuration. The two middle ribbons are folded in opposite directions, creating two folds running parallel to each other. The four ribbons are then aligned such that the two folds of the two middle ribbons lay adjacent one another and are secured or sandwiched between the bottom and top ribbons. Complete assembly of the display device from the four ribbons requires that the two middle ribbons be adhesively secured to the top and bottom ribbons. This is accomplished prior to folding and aligning or after the folding by applying adhesive in desired areas along the ribbons to be attached. Finally, the ribbons may be cut to the desired size to form a display device in the closed configuration.

A device constructed from the above method using four ribbons results in a display device defined by two folded sheets, aligned such that the folds are adjacent and parallel, both folded sheets being positioned, and adhesively secured in between two unfolded sheets. Preferably, the edges of the folded and unfolded sheets that run parallel to the folds are co-extensive, but not integral.

As indicated above, several manufacturing arrangements, including the use of a different number of ribbons or webs may be used to accomplish the preferred display device. For example, three ribbons may be used to form the device, where one ribbon is folded in the manufacturing process to encapsulate two folded ribbons, creating a fold between the top unfolded sheet and the bottom unfolded sheet. As a final step in forming the preferred device from this process, the fold adjoining the top unfolded sheet and the bottom unfolded sheet must be trimmed so that the device has parallel edges that are coextensive yet not adjoined. Other folding arrangements using two or even one ribbon are possible by appropriate folding, either with or without trimming.

BRIEF DESCRIPTION OF THE DRAWINGS

FIG. 3 is a perspective view of an eight panel display device in the open or deployed configuration in accordance with the present invention;

FIG. 4 is a sectional view of the display device shown in FIG. 3 taken along line 4'—4';

FIG. 5 is a top view of the display device shown in FIG. 3 in a closed or flat configuration;

DETAILED DESCRIPTION

Figure 1:
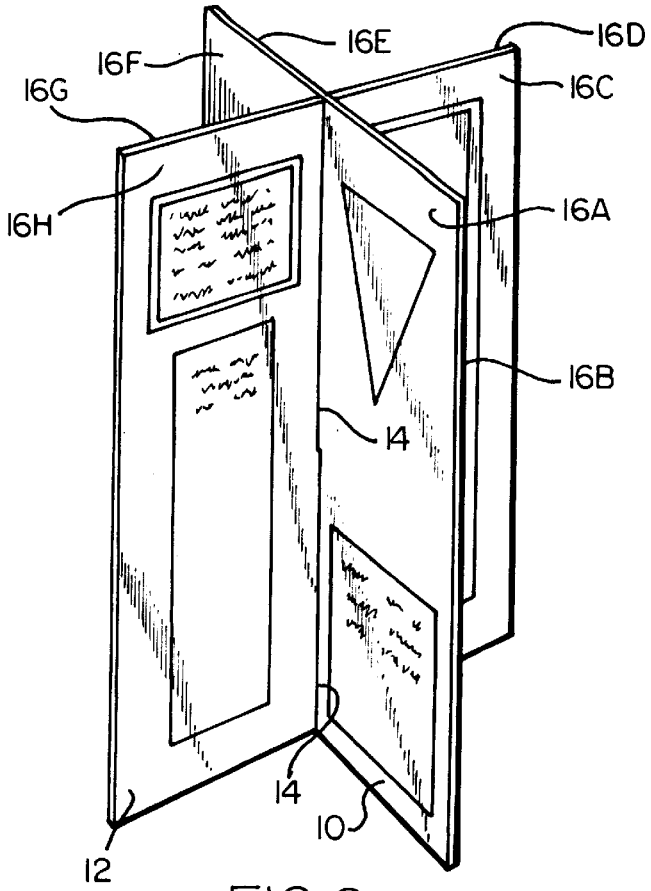
FIG. 1 PRIOR ART
FIG. 1 is a perspective view of an assembled prior art display stand with eight viewing panels.
Figure 2:
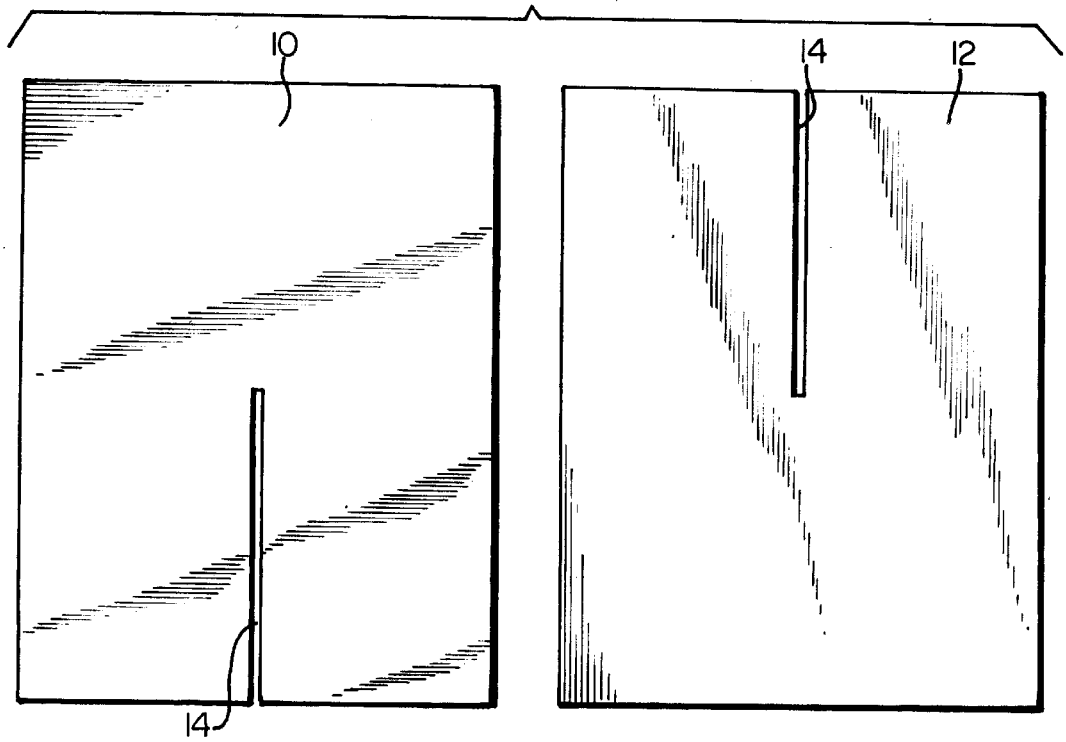
FIG. 2 PRIOR ART
FIG. 2 is a plan view of the display stand of FIG. 1 shown unassembled.

Referring to the Figures generally where like numerals refer to like parts, and in particular, to FIGS. 3–5, there is illustrated a display device 100 in accordance with the present invention. Display device 100 has eight (8) viewing panels. The viewing panels have printed matter, for example, a menu, wine list, calendar or advertisement. As best seen in FIG. 4, panels 102 and 104 are integral, being separated by a crease or fold 106. Similarly, panels 108 and 110 are integral, being adjoined by a crease or fold 112. Panels 114, 116 and fold 118, and panels 120, 122 and fold 124, have a similar relationship, respectively. The integral panels are formed from a sheet having an inner surface and an outer surface and the sheets are adhesively secured together at the inner surfaces, that is, the surfaces that are not visible. For example, the inner surface of panel 104 is adhesively secured to the inner surface of panel 108 by adhesive 126 and 128. The other half of the sheet formed by panel 104, panel 102, is adhesively secured to panel 122 via adhesive 130 and adhesive 132. As an alternative to applying adhesive in select areas, as shown in FIG. 4, for example, adhesive may be applied over the entire area of the sheets that will be in contact.

FIGS. 3 and 4 show display device 100 in an open or deployed configuration, which is defined by having the integral panels articulated about their adjoining fold. For example, panel 104 is articulated 90° from panel 102 about the fold 106. FIG. 5 shows the display device in a closed or flat configuration which, for example, may be used in shipping the display device. In the flat configuration, the eight viewing panels are articulated to be parallel with one another. In this configuration, the panels of two sheets are articulated to be 180° from each other, while the other two sheets have their panels articulated to be adjacent each other, that is, they have 0° of articulation between them. As shown in FIG. 5, panels 108, 110 and panels 122, 120 are articulated to be 180° from each other, respectively, thereby eliminating the creases 112, 124. The panels 102, 104 and panels 114, 116 are adjacent each other, respectively, with 0° between them. As best seen in FIG. 5, the display device 100, in the closed configuration is defined by two folded sheets (panels 102, 104 and panels 114, 116) adhesively secured and positioned between two unfolded sheets (panels 108, 110 and panels 120, 122).

Figure 6:
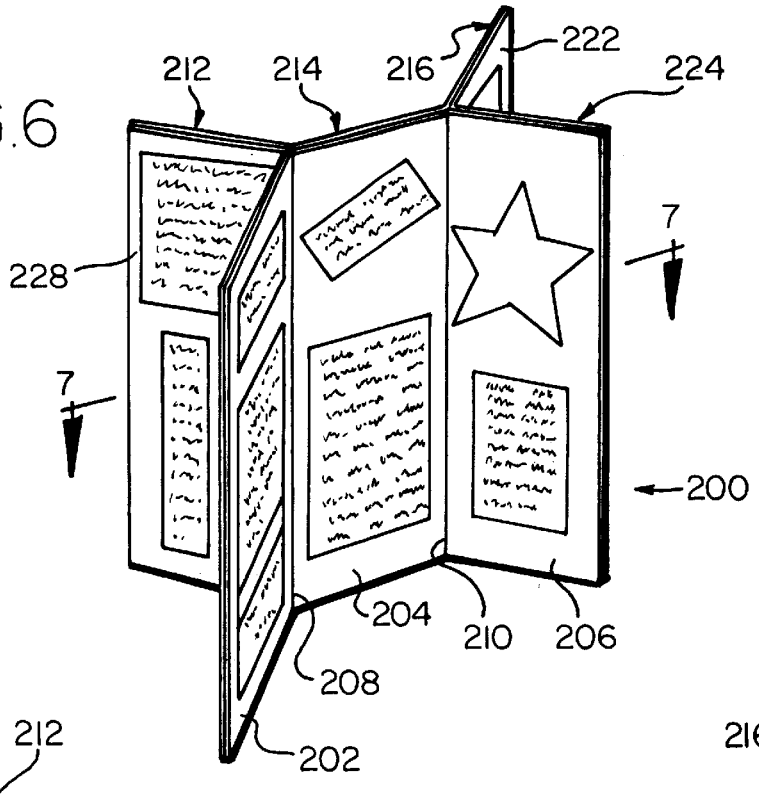
FIG. 6 is a perspective view of a ten panel display device in a deployed configuration in accordance with the present invention.
Figure 7:
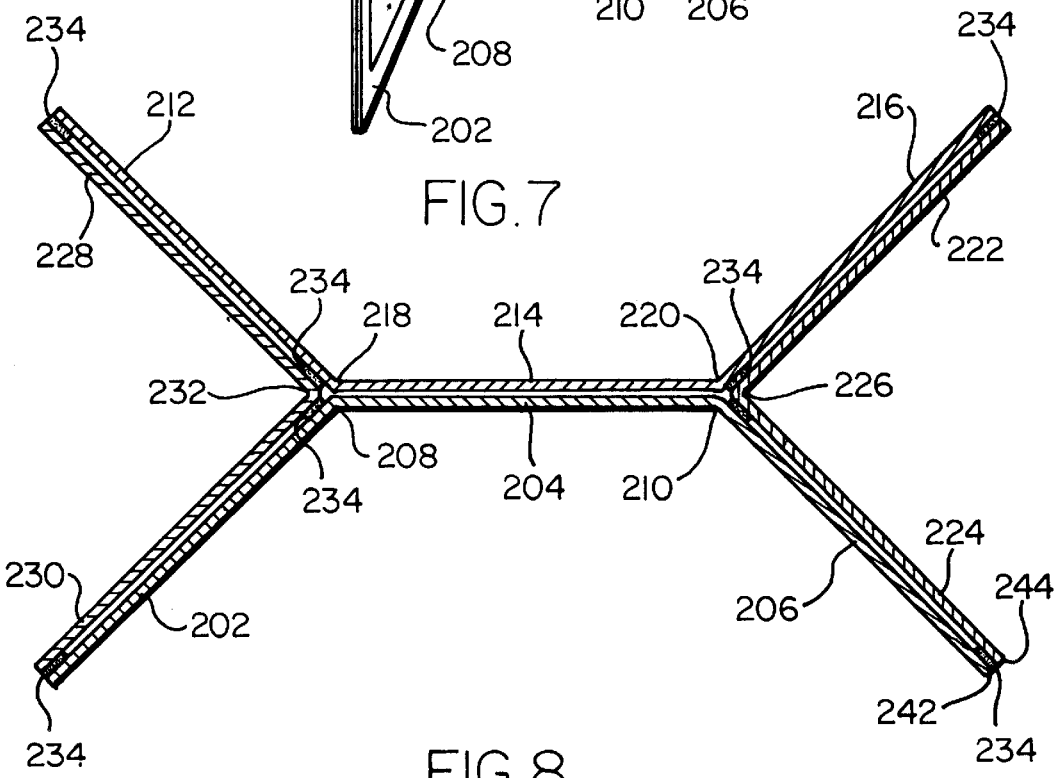
FIG. 7 is a sectional view of the display device shown in FIG. 6 taken along line 7'—7'.
Figure 8:
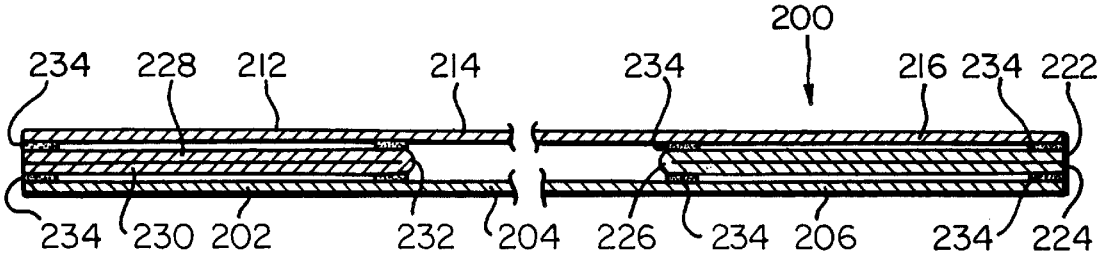
FIG. 8 is a top view of the display device shown in FIG. 6 in a closed or flat configuration.

FIGS. 6–8 illustrate an alternative embodiment of a display device in accordance with the present invention. Display device 200 has ten (10) viewing panels for displaying printed matter. As best seen in FIG. 7, panels 202, 204 and 206 are integral and formed by a single sheet, the panels being defined by fold 208 and fold 210. Similarly, panels 212, 214 and 216 are integral and formed by a single sheet, the panels being defined by fold 218 and fold 220. Panels 222 and 224 are integral and formed by a single sheet, the panels being divided by fold 226. Panels 228 and 230 are integral and formed from a single sheet, the panels being defined by fold 232. The sheets are adhesively secured together, preferably in areas near the folds and the edges, as shown by adhesive 234, but myriad other arrangements for the adhesive may be used.

FIGS. 6 and 7 show display device 200 in an open or deployed configuration such that device 200 may stand alone, that is, without additional support. Panels 222 and 224, along with panels 216 and 206, which they are adhesively secured to, respectively, are articulated for supporting device 200. Similarly, panels 228 and 230, which are adhesively secured to panels 212 and 202, respectively, are articulated to provide support for device 200. The angles at which the panels are articulated may vary. A preferable angle is substantially 90° between the panels of the sheets with two panels, as shown in FIGS. 6 and 7.

FIG. 8 shows device 200 in a flat or closed configuration, as is desirable for shipping device 200. In the closed configuration, panels 212, 214 and 216 are articulated to be parallel and coplanar with each other. Similarly, panels 202, 204 and 206 are articulated to be parallel and coplanar to each other. The sheet formed by panels 212, 214 and 216 is substantially flat and without folds. Similarly, the sheet formed by panel 202, 204 and 206 is substantially flat without folds. In the closed configuration, panels 222 and 224 are articulated to be adjacent and parallel to each other with fold 226 defining the point of intersection between the panels. Similarly, panels 228 and 230 are articulated to be adjacent and parallel each other with fold 232 defining the point of intersection between the panels.

As seen in FIG. 8, display device 200 is comprised of two folded sheets adhesively secured in between two unfolded sheets. The folds of the two folded sheets are separated from each other by a predetermined distance, the predetermined distance defining the width of the middle panels to the device, for example, in device 200, middle panels 204 and 214.

Display devices 100 and 200 shown and described above are preferably constructed from paper having a thickness of about 0.007 inches. The size and configuration of the sheets of paper used to form devices 100 and 200 may vary. The adhesive used to secure the sheets together to form devices 100 and 200 is preferably a permanent, water based envelope or spine glue. One such envelope glue is sold under the designation WA2907PK by Elekromek Co., Inc.

In the preferred embodiments of devices 100 and 200 the edges of the viewing panels are coextensive. For example, in device 100, shown in FIG. 4, edge 142 of panel 104 is coextensive with edge 144 of panel 108. Similarly, in device 200, shown in FIG. 7, edge 242 of panel 206 is coextensive with edge 244 of panel 224. Edges 242 and 244, though coextensive, are not integral. However, in alternative embodiments, various edges of the viewing panels may or may not be coextensive or integral.

Display devices 100 and 200 are well suited for mass manufacturing using printing press and inline finishing equipment. Construction may be accomplished by the use of plow folding stations, multiple glue application systems, a rotary cutter, and a delivery system, such equipment being well known to one of ordinary skill in the art.

A method for constructing display devices in accordance with the present invention may include several variations in the number of webs of material employed, the number of folds required to manipulate the webs, and the amount of cutting or trimming required to produce a finished product. FIGS. 9–13 illustrate a method for constructing display device 100 wherein a single web 300 is cut into four ribbons 302, 304, 306 and 308 prior to being realigned perpendicularly, folded and glued to form device 100.

Figure 9:
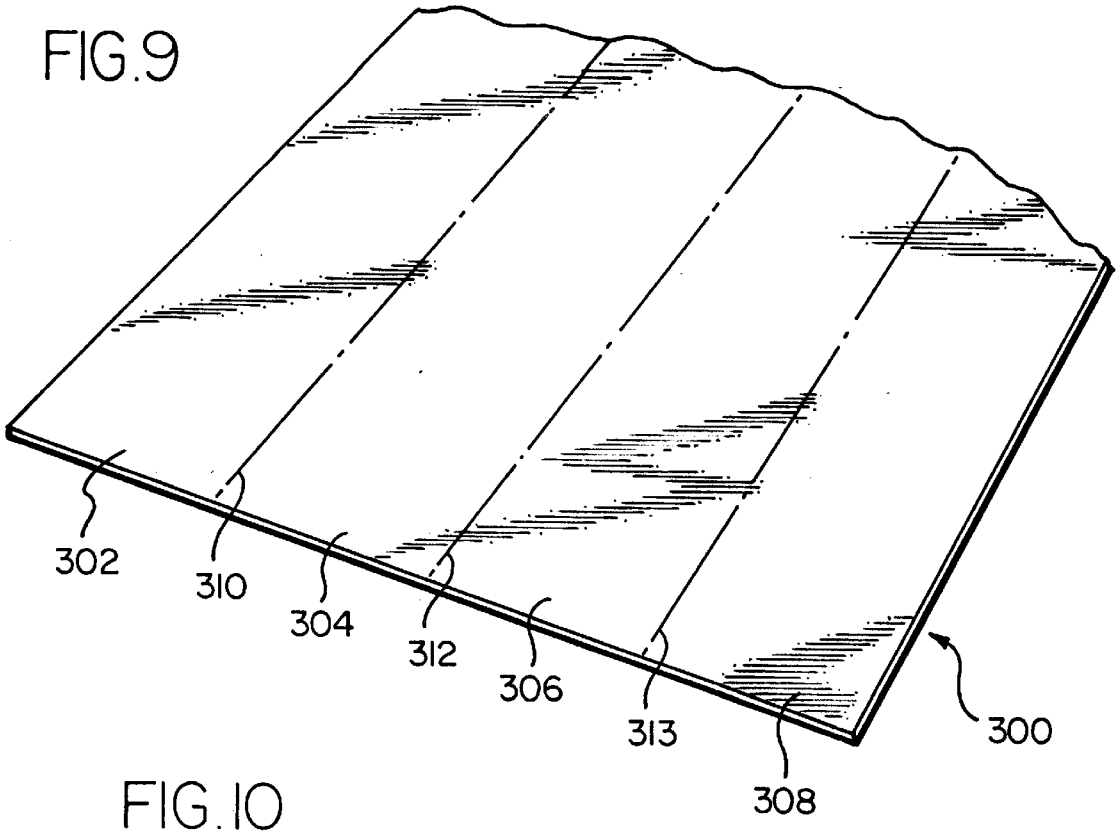
FIG. 9 shows a web used in forming a display device in accordance with the present invention.
Figure 10:
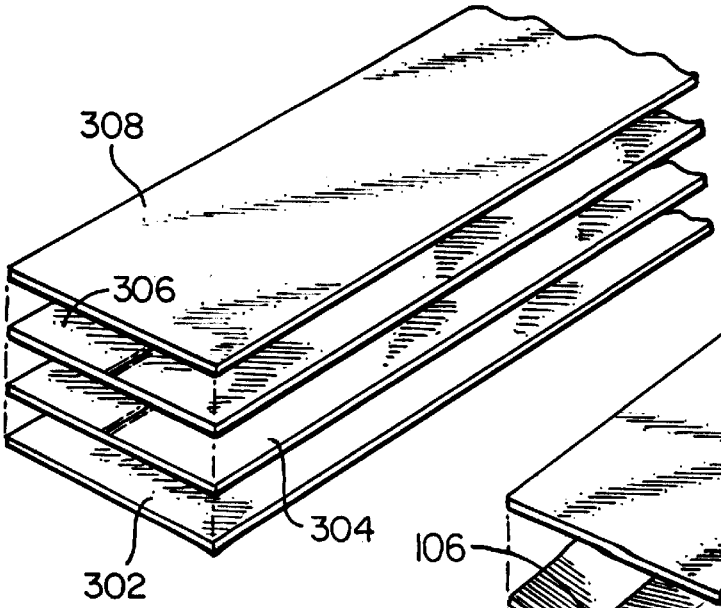
FIG. 10 is a perspective view of four ribbons derived from the web shown in FIG. 9.

Web 300, shown in FIG. 9, may be cut along lines 310, 312 and 313 to form four separate webs or ribbons 302, 304, 306 and 308, which may be vertically aligned as shown in FIG. 10. As best seen in FIG. 10, the ribbons 302, 304, 306 and 308 are substantially the same width. However, the widths of the ribbons may vary, and in particular, ribbon 304 can have a different width from ribbon 306.

Figure 11:
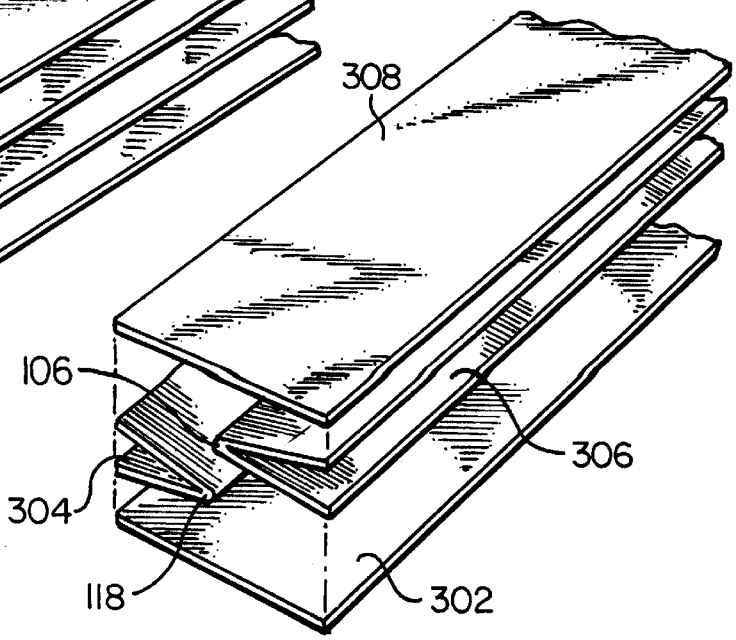
FIGS. 11 through 13 show various folding and gluing steps for forming a display device in accordance with the present invention.
Figure 12:
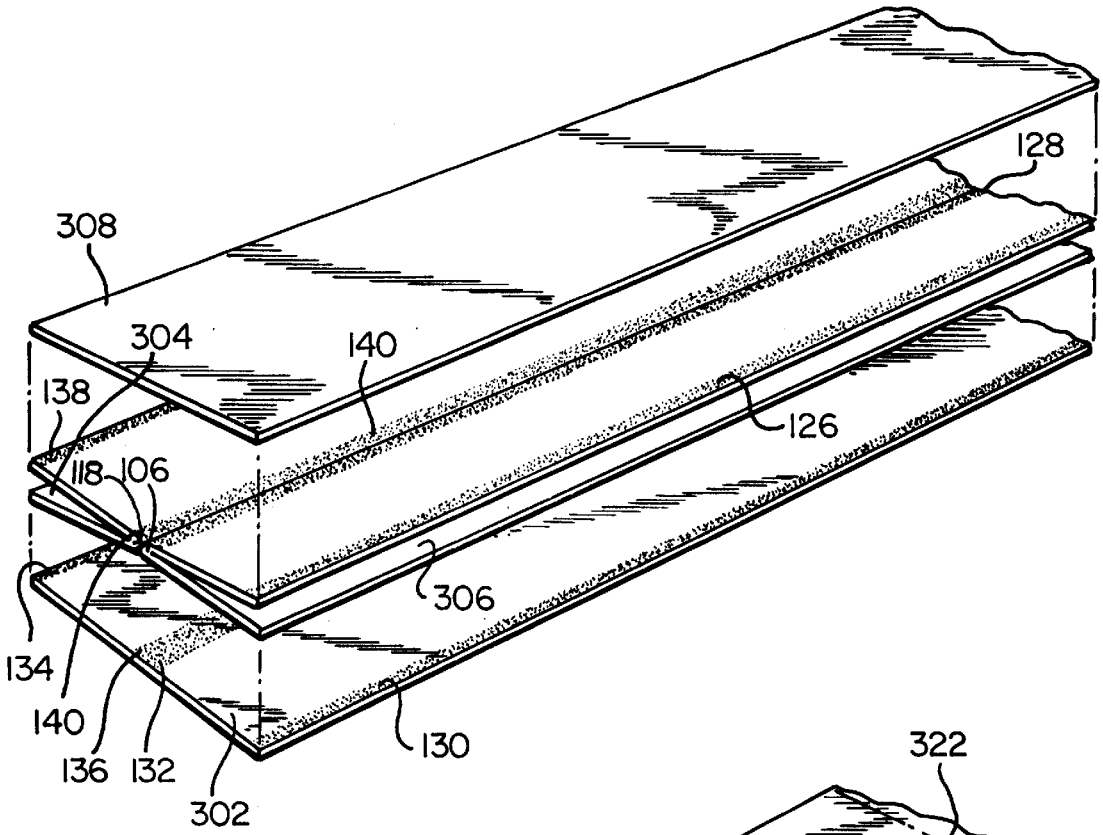
Figure 13:
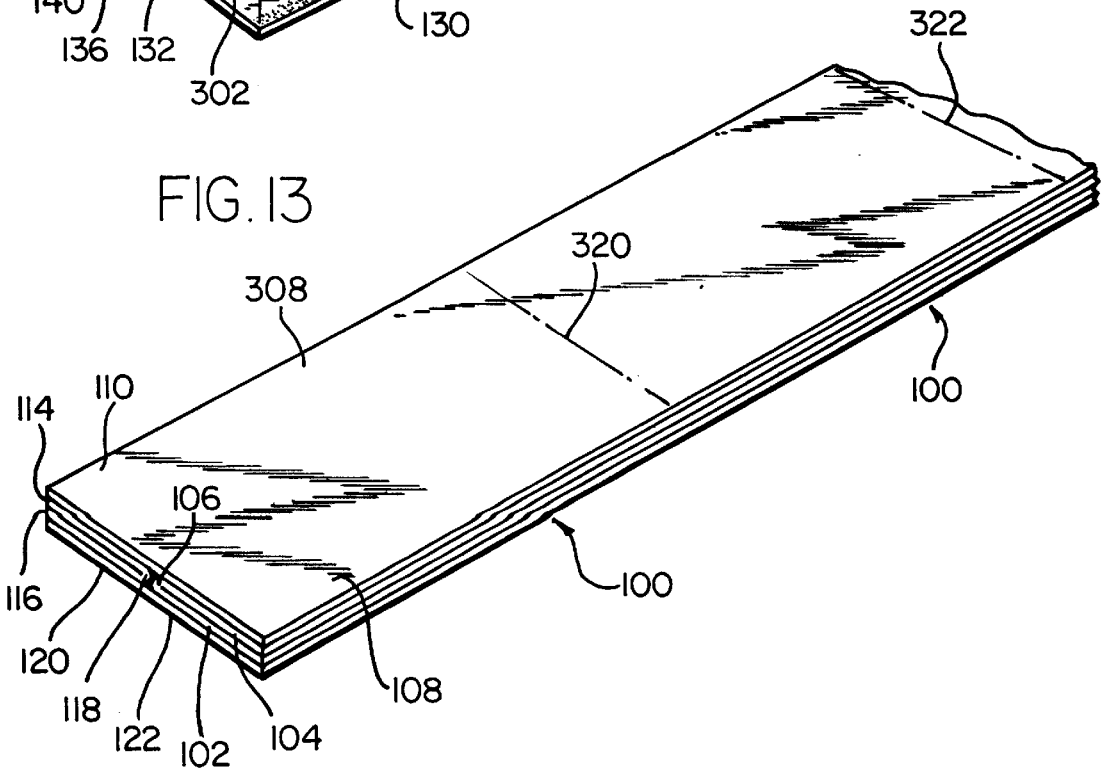

FIG. 11 shows middle ribbons 304 and 306 being folded in opposite directions to form folds 106 and 118 of device 100. Ribbons 304 and 306 are folded substantially in half and are aligned as shown in FIG. 12, with folds 106 and 118 aligned adjacent each other. FIG. 12 also shows the adhesive 126, 128, 130, 132, 134, 136, 138, 140 that must be placed on the ribbons prior to securing the ribbons together. The adhesive may be applied to the ribbons either before or after folding. Preferably, the adhesive is applied to a ribbon prior to folding that ribbon to avoid interference between applications of the adhesive and the folding function. Once the adhesive is in place, the ribbons are secured together as shown in FIG. 13. The display devices 100 may then be formed by cutting along the lines 320, 322.

The display device produced by the aforementioned method when manufactured is formed into a flat or closed configuration. This configuration facilitates easy shipment of multiple devices. At the point of initial deployment, the folded sheets are articulated, causing complimentary folds to be formed in the "unfolded" sheets to produce a three-dimensional, stand-alone display device.

Figure 14:
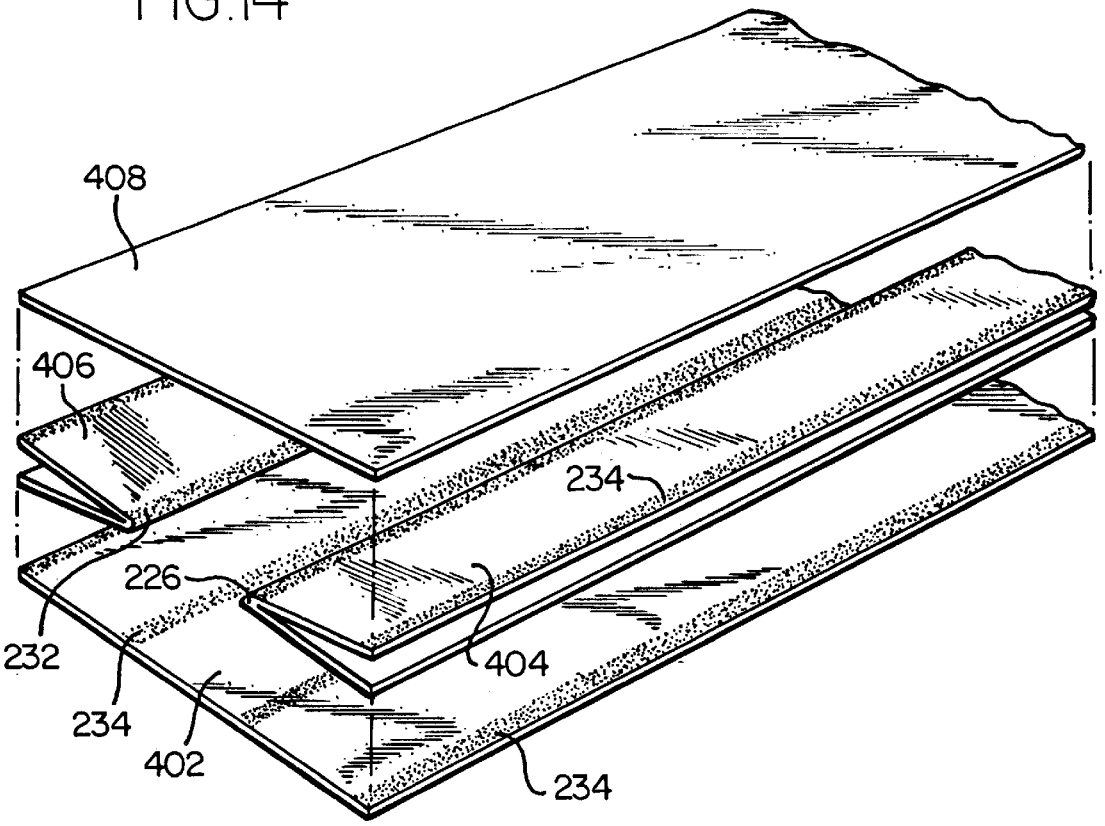
FIGS. 14 through 15 show alternative folding and gluing steps for forming a display device in accordance with the present invention.
Figure 15:
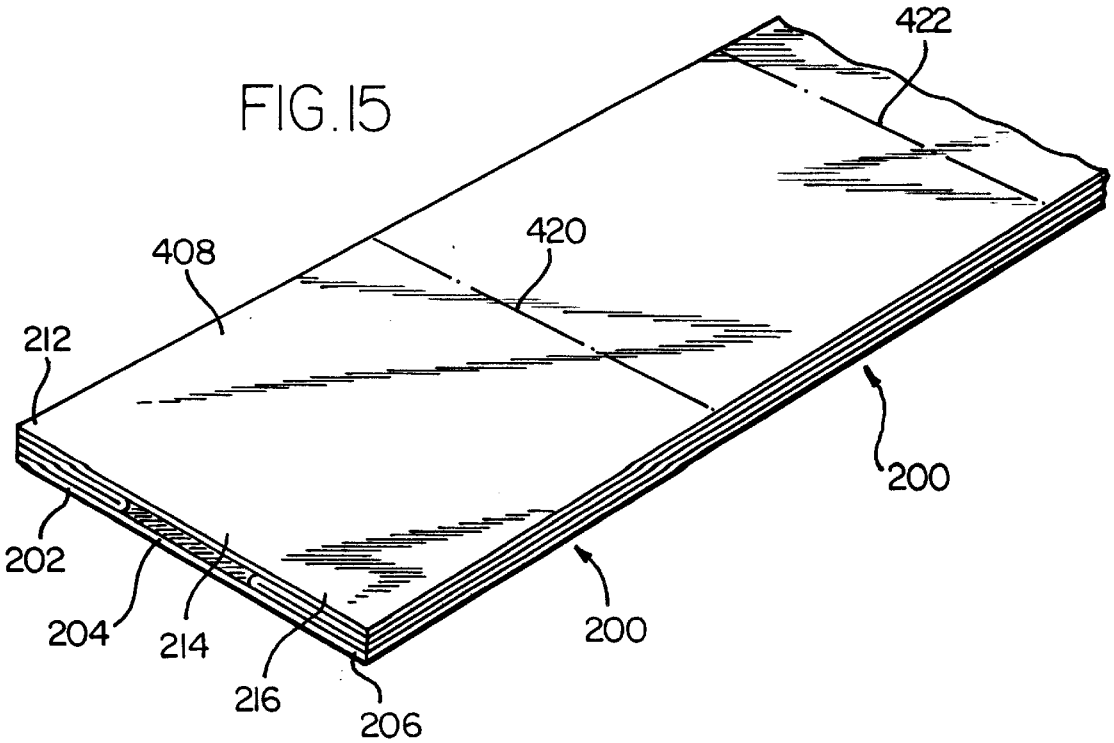

Display device 200 may be created using a method similar to the aforementioned method. In particular, FIG. 14 illustrates four (4) ribbons 402, 404, 406 and 408, which may have been cut from a single web of material, the middle ribbons 404 and 406 being folded to create folds 226 and 232 of device 200. Notably, the sizes of ribbons 404 and 406 are smaller in width than ribbons 402 and 408. The major difference in the method used in forming device 200 from the method used to form device 100 is the alignment of the middle webs or ribbons 404 and 406. For forming a display device 200, middle ribbons 404 and 406 are spaced a substantial distance apart, relatively, such that two additional panels are formed in the device. FIG. 15 illustrates an adhesively secured combination of ribbons to form display devices 200 once cut along lines 420, 422.

Figure 16:
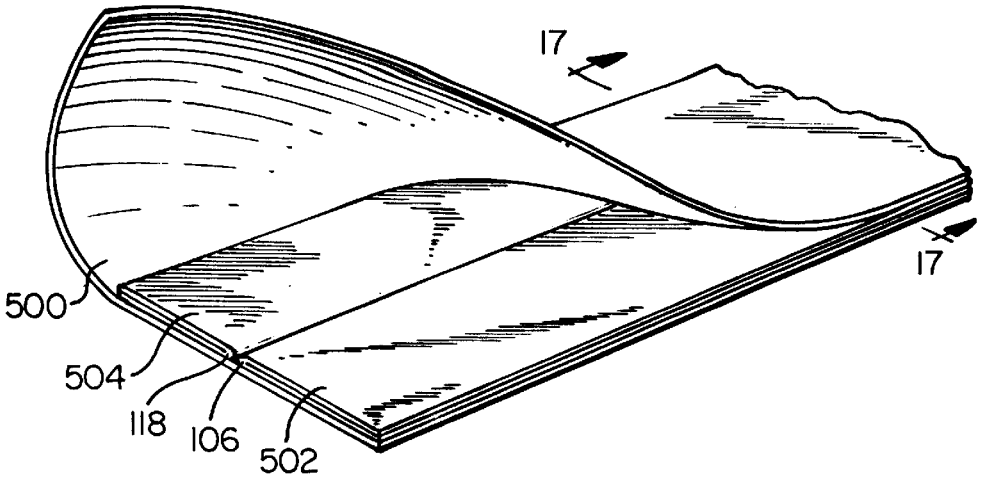
FIGS. 16 through 21 show alternative folding arrangements for forming alternative display device embodiments in accordance with the present invention.
Figure 17:
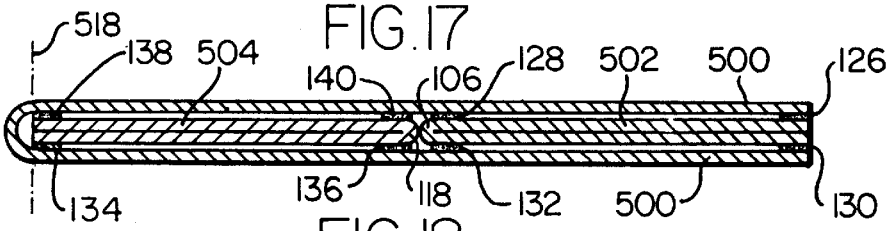

FIGS. 9–15 show devices 100 and 200 being formed from four (4) ribbons. Alternatively, the devices may be formed from three (3) ribbons, which may be cut from a single web. FIGS. 16 and 17 show three (3) ribbons 500, 502 and 504 being formed into a display device in accordance with the present invention. Ribbons 502 and 504 are folded to define folds 106 and 118. Then ribbon 500 is folded to encapsulate the ribbons 502 and 504. Of course, prior to the final alignment and folding, adhesive 126, 128, 130, 132, 134, 136, 138, and 140 must be placed in the desired locations. The arrangement formed from this method is shown in FIG. 17. To produce a display device 100 from this arrangement, trimming must occur along line 518. in this method, ribbon 500 may be folded either to the right or left with the appropriate trimming done to remove the fold so produced. This is the preferred method for forming the display device 100. For forming device 200, the method is adjusted to provide spacing between the folds formed in the two resulting middle folded sheets.

Figure 18:
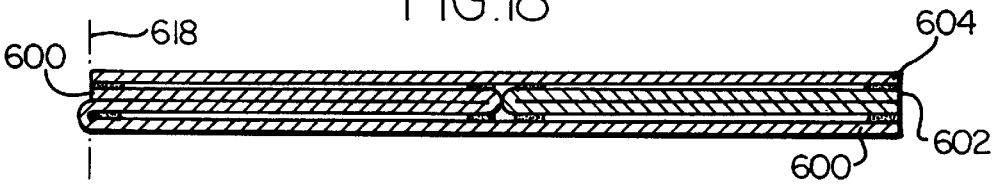

FIG. 18 shows another alternative arrangement using three (3) ribbons. In the arrangement shown in FIG. 18, the bottom ribbon 600 is folded to form one of the middle folded sheets. Middle ribbon 602 is folded to form the other middle folded sheet and top ribbon 604 becomes the top unfolded sheet. After alignment and securing, the device may be trimmed along line 618, which trimming in this case is actually optional.

Where the edge is not trimmed, the bottom "unfolded" sheet is integral with one of the middle folded sheets. Adhesive near the integral edge becomes optional.

Figure 19:
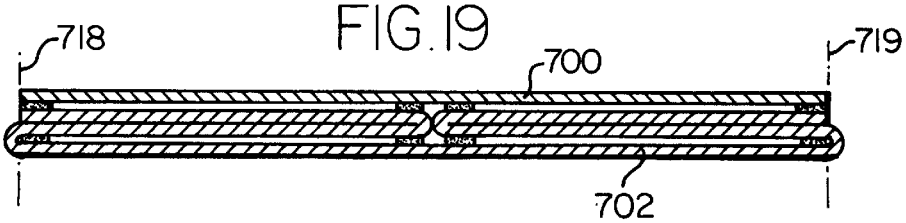
Figure 20:
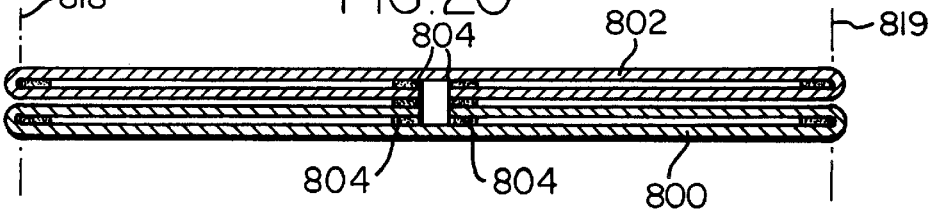

FIG. 19 shows another arrangement for creating a display device in accordance with the present invention. The arrangement shown in FIG. 19 is formed from two ribbons of material 700 and 702. Top ribbon 700 is not folded, while bottom ribbon 702 is folded to form the two middle folded sheets. As with the arrangement shown in FIG. 18, the trimming shown along lines 718 and 719 is optional. Where there is no trimming, the device so formed may be integral along the edges between panels adhesively secured together. If the edges are left integral, adhesive is optional near those edges. FIG. 20 shows another arrangement using two (2) ribbons 800 and 802, both of which are folded and secured by adhesive 804. Trimming along lines 818 and 819 is optional. If the edges are not trimmed, adhesive may not be needed near the edges of the panels.

Figure 21:
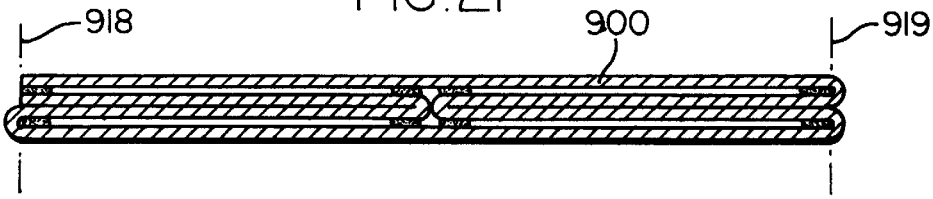

An additional arrangement for creating display devices is shown in FIG. 21. This arrangement is formed using one web or ribbon 900. The one ribbon is folded and adhesively secured to form the arrangement shown in FIG. 21, which may or may not require trimming along lines 918, 919.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A display device having a closed configuration and a deployed configuration, wherein said closed configuration comprises:

a top sheet and a bottom sheet, said top sheet and said bottom sheet each having an inner surface and an outer surface, and a first edge and a second edge opposite said first edge; said top sheet and said bottom sheet each being unfolded when the display device is in said closed configuration;

a first folded sheet and a second folded sheet, each said folded sheet having an inner surface, an outer surface, and a fold defining a point of intersection between a first panel and a second panel; said first panel of said first folded sheet being adjacent said second panel of said first folded sheet, and said first panel of said second folded sheet being adjacent said second panel of said second folded sheet; said first folded sheet and said second folded sheet being disposed between said top sheet and said bottom sheet such that said folds are opposed to each other;

said first folded sheet having a portion of the inner surface of its first panel adhesively secured to the inner surface of said top sheet and a portion of the inner surface of its second panel adhesively secured to the inner surface of said bottom sheet; said second folded sheet having a portion of the inner surface of its first panel adhesively secured to the inner surface of said top sheet and a portion of the inner surface of its second panel adhesively secured to the inner surface of said bottom sheet;

wherein said display device is movable to said deployed configuration by articulation and partial unfolding of said first and second folded sheets along their respective folds from said closed configuration, such that in said deployed configuration, said first panel and said second panel of said first folded sheet are spaced apart and positioned angularly with respect to each other along the fold of said first folded sheet, and said first panel of said second panel of said second folded sheet are spaced apart and positioned angularly with respect to each other along the fold of said second folded sheet; and upon the articulation and the partial unfolding of the first and second folded sheets, each said top sheet and said bottom sheet forms at least one fold therein, said at least one fold being parallel to said first edge and said second edge and said folds in said folded sheets, such that each said at least one fold forms a third panel on each of said top sheet and said bottom sheet between said first edge and each at least one fold and a fourth panel on each of said top sheet and said bottom sheet between said second edge and said at least one fold, such that said third panel and said fourth panel of said top sheet are separated at an angle of less than 180 degrees from each other and said third panel and said fourth panel of said bottom sheet are separated at an angle of less than 180 degrees from each other, the angles at which said folded sheets and said top and bottom sheets are articulated being sufficient to allow the display device to stand on its own while in the deployed configuration.

2. The device of claim 1 wherein said first panels of said folded sheets are substantially the same size as said second panels of said folded sheets, respectively.

3. The device of claim 2, wherein said first panel of said first folded sheet is substantially the same size as said first panel of said second folded sheet.

4. The device of claim 3 wherein said second panel of said first folded sheet is substantially the same size as said second panel of said second folded sheet.

5. The device of claim 1 wherein an edge of the first panel of the first folded sheet is coextensive with the first edge of the top sheet; and wherein an edge of the second panel of the first folded sheet is coextensive with the first edge of the bottom sheet; and wherein an edge of the first panel of the second folded sheet is coextensive with the second edge of the top sheet; and wherein an edge of the second panel of the second folded sheet is coextensive with the second edge of the bottom sheet.

6. The device of claim 1 wherein the inner surfaces of the first and second panels of the first folded sheet are adhesively secured to the inner surfaces of the top and bottom sheets, respectively, in areas near the fold of the first folded sheet; and wherein the inner surfaces of the first and second panels of the second folded sheet are adhesively secured to the inner surfaces of the top and bottom sheets, respectively, in areas near the fold of the second folded sheet.

7. The device of claim 6 wherein the inner surface of the first panel of the first folded sheet is adhesively secured to the inner surface of the top sheet in an area near the first edge of the top sheet.

8. The device of claim 6 wherein the inner surface of the second panel of the first folded sheet is adhesively secured to the inner surface of the bottom sheet in an area near the first edge of the bottom sheet.

9. The device of claim 6 wherein the inner surface of the first panel of the second folded sheet is adhesively secured to the inner surface of the top sheet in an area near the second edge of the top sheet.

10. The device of claim 6 wherein the inner surface of the second panel of the second folded sheet is adhesively secured to the inner surface of the bottom sheet in an area near the second edge of the bottom sheet.

11. The device of claim 1 wherein said bottom sheet is integral with said second folded sheet at the second edge of said bottom sheet, said second edge of said bottom sheet being a fold defining a point of intersection between said bottom sheet and said second panel of said second folded sheet.

12. The device of claim 1 wherein said bottom sheet is integral with said first folded sheet at the first edge of said bottom sheet, said first edge of said bottom sheet being a fold defining a point of intersection between said bottom sheet and said second panel of said first folded sheet.

13. The device of claim 11 wherein said bottom sheet is integral with said first folded sheet at the first edge of said bottom sheet, said first edge of said bottom sheet being a fold defining a point of intersection between said bottom sheet and said second panel of said first folded sheet.

14. The device of claim 13 wherein said top sheet is integral with said second folded sheet at the second edge of said top sheet, said second edge of said top sheet being a fold defining a point of intersection between said top sheet and said first panel of said second folded sheet.

15. The device of claim 13 wherein said top sheet is integral with said first folded sheet at the first edge of said top sheet, said first edge of said top sheet being a fold defining a point of intersection between said top sheet and said first panel of said first folded sheet.

16. The device of claim 1 wherein said first and second folded sheets and said top and bottom sheets have a thickness of about 0.007 inches.

17. The device of claim 1 wherein said folded sheets are adhesively secured to said top and bottom sheets with water-based permanent glue.

18. The device of claim 1 wherein the fold of the first folded sheet is adjacent the fold of the second folded sheet.

19. The device of claim 1 wherein the fold of the first folded sheet is spaced apart from the fold of the second folded sheet.

20. The device of claim 1 wherein in said deployed configuration, said first panel of said first folded sheet is spaced apart from said second panel of said first folded sheet by an angle of approximately 90 degrees and said first panel of said second folded sheet is spaced apart from said second panel of said second folded sheet by an angle of approximately 90 degrees; and said at least one fold formed in said top sheet between said first edge and said second edge has an angle of approximately 90 degrees, and said at least one fold formed in said bottom sheet between said first edge and said second edge has an angle of approximately 90 degrees.

21. A display device having a deployed configuration and a closed configuration, wherein said closed configuration comprises:

a top sheet and a bottom sheet, said top sheet and said bottom sheet each having an inner surface, an outer surface, a first edge and a second edge opposite said first edge; said top sheet and said bottom sheet each being unfolded when the display device is in said closed configuration;

a first folded sheet and a second folded sheet, each said folded sheet having an inner surface, an outer surface, and a fold defining a point of intersection between a first panel and a second panel; said first panel of said first folded sheet being adjacent said second panel of said first folded sheet, and said first panel of said second folded sheet being adjacent said second panel of said second folded sheet; said first folded sheet and said second folded sheet being disposed between said top sheet and said bottom sheet such that said folds are opposed to each other;

said first folded sheet having the inner surface of its first panel adhesively secured to the inner surface of said top sheet in areas near the fold of said first folded sheet and near the first edge of said top sheet, and the inner surface of its second panel adhesively secured to the inner surface of said bottom sheet near the fold of the first folded sheet and near the first edge of the bottom sheet;

said second folded sheet having the inner surface of its first panel adhesively secured to the inner surface of said top sheet in areas near the fold of the second folded sheet and near the second edge of said top sheet, and the inner surface of its second panel adhesively secured to the inner surface of said bottom sheet in areas near the fold of said second folded sheet and near the second edge of said bottom sheet;

wherein said display device is movable to said deployed configuration by articulation and partial unfolding of said first and second folded sheets along their respective folds from said closed configuration, such that in said deployed configuration, said first panel and said second panel of said first folded sheet are spaced apart and positioned angularly with respect to each other along the fold of said first folded sheet, and said first panel of said second panel of said second folded sheet are spaced apart and positioned angularly with respect to each other along the fold of said second folded sheet; and upon the articulation and the partial unfolding of the first and second folded sheets, each said top sheet and said bottom sheet forms at least one fold therein, said at least one fold being parallel to said first edge and said second edge and said folds in said folded sheets, such that each said at least one fold forms a third panel on each of said top sheet and said bottom sheet between said first edge and each at least one fold and a fourth panel on each of said top sheet and said bottom sheet between said second edge and said at least one fold, such that said third panel and said fourth panel of said top sheet are separated at an angle of less than 180 degrees from each other and said third panel and said fourth panel of said bottom sheet are separated at an angle of less than 180 degrees from each other, the angles at which said folded sheets and said top and bottom sheets are articulated being sufficient to allow the display device to stand on its own while in the deployed configuration.

22. The device of claim 21 wherein said first panels of said folded sheets are substantially the same size as said second panels of said folded sheets, respectively.

23. The device of claim 22 wherein said first panel of said first folded sheet is substantially the same size as said first panel of said second folded sheet.

24. The device of claim 23 wherein said second panel of said first folded sheet is substantially the same size as said second panel of said second folded sheet.

25. The device of claim 24 wherein an edge of the first panel of the first folded sheet is coextensive with the first edge of the top sheet; and wherein an edge of the second panel of the first folded sheet is coextensive with the first edge of the bottom sheet; and wherein an edge of the first panel of the second folded sheet is coextensive with the second edge of the top sheet; and wherein an edge of the second panel of the second folded sheet is coextensive with the second edge of the bottom sheet.

26. The device of claim 25 wherein the fold of the first folded sheet is adjacent the fold of the second folded sheet.

27. The device of claim 25 wherein the fold of the first folded sheet is spaced apart from the fold of the second folded sheet.

28. A display device having a flat configuration and an open configuration, wherein said flat configuration comprises:

a first side sheet and a second side sheet, each said side sheet having an inner surface, an outer surface, a first edge, and a second edge opposite said first edge; each said side sheet being unfolded when the display device is in said flat configuration;

a first folded sheet and a second folded sheet, each said folded sheet having an inner surface, an outer surface, and a fold defining a point of intersection between a first panel and a second panel; said first folded sheet and said second folded sheet being disposed between said side sheets with said folds in opposed orientation;

said first side sheet having discrete portions of its inner surface adhesively secured to the inner surface of each of said first panels of said folded sheets, said second side sheet having discrete portions of its inner surface adhesively secured to the inner surface of each of said second panels of said folded sheets; and wherein said open configuration comprises:

said first panel and said second panel of said first folded sheet being spaced apart from each other and said first panel and said second panel of said second folded sheet being spaced apart from each other;

said side sheets forming at least one fold therein when the display device is deployed to the open configuration, said at least one fold being disposed between said first edge and said second edge and parallel to said folds in said first folded sheet and said second folded sheet, each of said folds formed in said first side sheet defining a point of intersection between two planar faces; each of said folds formed in said second side sheet defining a point of intersection between two planar faces; said two planar faces of said first side sheet being oriented angularly to each other and said two planar faces of said second side sheet being oriented angularly to each other, said angular orientation within said folded sheets and said side sheets being sufficient to allow the display device to stand on its own.

* * * * *